US008512542B2

(12) United States Patent
Heinrichsdorff et al.

(10) Patent No.: US 8,512,542 B2
(45) Date of Patent: Aug. 20, 2013

(54) METHOD FOR THE ELECTROCHEMICAL COATING OF A SUBSTRATE BY BRUSH PLATING AND DEVICE FOR CARRYING OUT SAID METHOD

(75) Inventors: Frank Heinrichsdorff, Mahlow (DE); Jens Dahl Jensen, Berlin (DE); Hans-Richard Kretschmer, Berlin (DE); Daniel Reznik, Berlin (DE); Arno Steckenborn, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 181 days.

(21) Appl. No.: 12/736,547

(22) PCT Filed: Apr. 1, 2009

(86) PCT No.: PCT/EP2009/053844

§ 371 (c)(1),
(2), (4) Date: Oct. 18, 2010

(87) PCT Pub. No.: WO2009/127518

PCT Pub. Date: Oct. 22, 2009

(65) Prior Publication Data

US 2011/0031125 A1 Feb. 10, 2011

(30) Foreign Application Priority Data

Apr. 16, 2008 (DE) ..... 10 2008 019 864

(51) Int. Cl.

| | |
|---|---|
| ***C25D 5/00*** | (2006.01) |
| ***C25D 5/22*** | (2006.01) |
| ***C25D 15/00*** | (2006.01) |
| ***C25D 5/06*** | (2006.01) |

(52) U.S. Cl.
USPC ..... 205/109; 205/80; 205/93; 205/117

(58) Field of Classification Search
USPC ..... 205/117, 80, 93, 109
See application file for complete search history.

(56) References Cited

U.S. PATENT DOCUMENTS

| | | | |
|---|---|---|---|
| 5,225,059 | A | 7/1993 | Penrose |
| 5,620,575 | A | 4/1997 | Karasawa et al. |

(Continued)

FOREIGN PATENT DOCUMENTS

| | | |
|---|---|---|
| CN | 1721579 | 1/2006 |
| DE | 10 2004 030 523 | 1/2006 |

(Continued)

OTHER PUBLICATIONS

University of Illinois, Metal Finishing Industry Glossary, http://www.istc.illinois.edu/info/library_docs/manuals/finishing/appxa1.htm.*

(Continued)

*Primary Examiner* — Luan Van
*Assistant Examiner* — Ho-Sung Chung
(74) *Attorney, Agent, or Firm* — Staas & Halsey LLP

(57) ABSTRACT

A method for the electrochemical coating of a substrate uses brush plating. This is to take place with an electrolyte in that particles are dispersed, which are embedded into the developing layer. It is proposed to add the particles to the carrier for the electrolyte by way of a separate conduit system. The electrolyte is added by way of a conduit system. In this way it is achieved that an agglomeration of the particles in the electrolyte can be prevented because only a short time passes between when the particles are fed and the layer is formed. A device for electrochemical coating has two conduit systems provided for this purpose.

10 Claims, 3 Drawing Sheets

(56) References Cited

U.S. PATENT DOCUMENTS

| | | | | |
|---|---|---|---|---|
| 6,375,823 | B1 | 4/2002 | Matsuda et al. | |
| 7,699,077 | B2 | 4/2010 | Jensen et al. | |
| 2003/0234181 | A1 | 12/2003 | Palumbo et al. | |
| 2005/0211560 | A1 * | 9/2005 | Matsuda et al. | 205/117 |
| 2007/0036978 | A1 | 2/2007 | Chen | |
| 2007/0199826 | A1 * | 8/2007 | Son et al. | 205/238 |
| 2008/0023087 | A1 * | 1/2008 | Jensen et al. | 137/807 |

FOREIGN PATENT DOCUMENTS

| | | |
|---|---|---|
| DE | 10 2008 019 864.1 | 4/2008 |
| JP | 1-301897 | 12/1989 |
| WO | 2007/073339 | 6/2007 |
| WO | PCT/EP2009/053844 | 4/2009 |

OTHER PUBLICATIONS

University of Illinois, Metal Finishing Industry Glossary, Oct. 18, 2008, originally at http://www.istc.illinois.edu/info/library_docs/manuals/finishing/appxa1.htm, date verified at http://web.archive.org/web/20081018214831/http://www.istc.illinois.edu/info/library_docs/manuals/finishing/appxa1.htm.*

Database WPI Week 200639, Thomson Scientific, London, Great Britain, 2006-373909, XP002550716, 1 page.

Wu et al., "Preparation and properties of Ni/nano-$AI_2O_3$ composite coatings by automatic brush plating," Surface and Coatings Technology, Elsevier, vol. 201, No. 16-17, Apr. 13, 2007, pp. 6933-6939.

International Search Report for PCT/EP2009/053844, mailed on Nov. 6, 2009.

* cited by examiner

METHOD FOR THE ELECTROCHEMICAL COATING OF A SUBSTRATE BY BRUSH PLATING AND DEVICE FOR CARRYING OUT SAID METHOD

CROSS REFERENCE TO RELATED APPLICATIONS

This application is based on and hereby claims priority to International Application No. PCT/EP2009/053844 filed on Apr. 1, 2009 and German Application No. 10 2008 019 864.1 filed on Apr. 16, 2008, the contents of which are hereby incorporated by reference.

BACKGROUND

The invention relates to a process for the electrochemical coating of a substrate by brush plating, in which process an electrolyte, in which particles are dispersed, is applied to the substrate using a carrier, wherein a metallic layer, in the matrix of which the particles are incorporated, forms on the substrate.

A process of the type mentioned in the introduction can be gathered, for example, from JP 01301897 A. This document proposes the use of a brush plating process for producing a layer in which particles are dispersed. Brush plating is to be understood as meaning an electrochemical coating process in which the substrate to be coated is not dipped into an electrolyte, but instead the electrolyte is applied to the substrate using a carrier referred to as a brush. More specifically, a brush does not have to be used in this process. Instead, the carrier has to have the properties which make it capable of transferring the electrolyte onto the substrate owing to superior capillary forces. By way of example, a brush is suitable for this purpose because capillary channels suitable for transporting the electrolyte are formed between the individual bristles. Examples of other structures suitable for transferring the electrolyte are sponge-like, i.e. open-pored, inherently elastic materials.

In order to make effective coating possible, the carrier is fed with electrolyte through a channel system, which is fluidically connected to the capillary channels of the carrier. Compared to conventional electrochemical coating, in which the substrate is dipped into the electrolyte, the significant advantage is that a high material throughput is made possible by the continuous feed of electrolyte. During electroplating, for example, correspondingly high deposition currents can accordingly be implemented, and rapid layer build-up is thereby possible. In contrast to electrolyte baths, the continuous flow of the electrolyte in brush plating makes it possible to prevent the establishment of a steady state, which limits the coating rate, in the electrolyte owing to a limited diffusion rate.

It goes without saying that it is also known to incorporate particles in electrochemically produced layers which have been coated in an electrochemical bath. By way of example, it is known according to U.S. Pat. No. 2007/0036978 A1 to incorporate CNTs (this abbreviation is used hereinbelow for carbon nanotubes) in electrochemically deposited layers. However, a factor which further limits the incorporation of the CNTs in this case is the fact that the CNTs can only be dispersed in the electrochemical bath to a limited extent. The production of stable dispersions, i.e. dispersions which also remain stable for a relatively long period of time of more than 24 hours, creates problems. Although it is possible to stabilize the dispersion by using wetting agents, the latter are then also deposited at least partially in the layers. However, an improvement in the conductivity is sought, for example, with the incorporation of CNTs in electrochemical layers. However, the presence of wetting agents, which primarily remain on the surface of the CNTs, restricts the desired effect of the incorporation of CNTs in the metallic matrix of the electrochemically deposited layer.

SUMMARY

One possible object of the invention is therefore to specify a process for the electrochemical coating of substrates by brush plating, in which process it is possible to achieve relatively high particle incorporation rates.

The inventors propose a process in which the carrier is fed via two fluidically independent supply systems, namely via a first conduit system for the electrolyte, in which the concentration of particles is at least reduced compared to the required concentration, or no particles are present, and a second conduit system for the particles, by which particles are added to the electrolyte until the required concentration of particles is achieved therein. The process has the advantageous effect that no stable dispersion of particles has to be produced in the electrolyte. Instead, use is made of the fact that the time which passes until the electrolyte fed into the carrier reaches the surface of the substrate to be coated is very short in brush plating. In addition, the electrolyte is guided via the capillary channels formed by the carrier, which make agglomeration in the electrolyte more difficult. Therefore, undesirable agglomeration of particles during the short time until the substrate is coated from the constituents of the electrolyte is very unlikely. This has the advantage that it is also possible to use particles such as CNTs, which are poorly dispersible per se in the available electrolytes. Another possibility for making meaningful use of this fact relates to the fact that it is possible to add the particles in relatively high concentrations, which are normally no longer stable as a dispersion in the electrolyte in question. This makes it possible to increase the rate of incorporation of particles in the layer which forms. The process window available for forming electrochemical layers with dispersed particles is therefore advantageously larger.

A further advantage of brush plating arises from the fact that the transfer medium is in contact with the substrate during the layer formation process. This counteracts dendritic layer growth, since the layer which forms is compacted immediately. Specifically, the introduction of CNTs would otherwise promote the formation of dendrites—with negative effects on the quality of the layer.

According to one particular refinement, the required concentration of particles in the electrolyte is at a value above a critical value for stability of the dispersion. The advantages of a resulting increased rate of incorporation of particles in the layer which forms have already been explained.

According to another refinement, the particles are supplied in the second conduit system as a dispersion. The dispersing agent used in this case may equally be a gas (formation of an aerosol), a liquid (formation of a suspension) or a solid (formation of a solid mixture). If a solid is used, a powder which can be handled, metered and produced more easily is preferably formed from particles larger than the particles to be dispersed in the layer to be formed. However, it is also possible to convey and meter the particles to be incorporated in the layer to be formed as a powder. However, the use of dispersions has the advantage that handling is generally simplified. The electrolyte itself is preferably also used as the liquid dispersing agent. The electrolyte fed in through the first conduit system and the electrolyte fed in through the second conduit system therefore merely differ in terms of the concentration of dispersed particles. The electrolyte in the first conduit system, which makes up the majority of the throughput, is advantageously not provided with a relatively large quantity of particles in this case, such that handling is advantageously simplified. Particularly if the electrolyte is used repeatedly, i.e. the electrolyte is collected after brush plating has taken place and returned into the supply unit from which the first conduit system is fed, it may be the case, however, that small quantities of particles are present in the electrolyte. However, these do not bring about the problems of agglomeration mentioned above since, if a critical concentration is reached, the particles already precipitate in the collection container after brush plating has taken place and are therefore not returned into the supply container.

On the other hand, the relatively small quantity of electrolyte fed in through the second conduit system can be mixed in each case briefly before it is used, and therefore long-term stability of this suspension is not required. Alternatively, the liquid dispersing agent used can also be a liquid in which it is easier to disperse the relevant particles. However, this dispersing agent must not have an undesirable influence on the coating process of the brush plating. This has to be taken into consideration accordingly when selecting the dispersing agent.

If a liquid or else a solid is supplied as the dispersing agent, these can advantageously be selected such that the dispersing agent evaporates or sublimates at the temperatures which prevail during the brush plating. It is thereby withdrawn from the brush plating process before it can be incorporated in the coating which forms. It may be necessary to ensure that there is a suitable collecting device, which prevents the gaseous dispersing agent from escaping into the surroundings. This makes it possible to avoid any possible risks to health and for the dispersing agent to be used for renewed dispersion formation.

According to another refinement of the process, agglomeration of the particles is prevented by the action of an energy, in particular ultrasound, in the second conduit system. Supercritical dispersions can thereby advantageously also be used, since the risk of the dispersed particles already agglomerating in the second conduit system can be reduced by the introduction of energy. Particularly if ultrasound is used, this can also be introduced into the carrier, such that agglomeration of the particles is prevented in this region too. These particles can thereby be incorporated individually in the matrix of the layer which forms.

A further advantageous refinement is obtained if the particles are nanoparticles, in particular CNTs. If nanoparticles are used, it is advantageously possible to produce particularly fine layer structures on the component to be coated. In addition, the above-mentioned mechanisms for preventing the agglomeration of nanoparticles before they are incorporated in the layer can be utilized particularly effectively. In particular, the incorporation of CNTs in a metallic matrix without the use of wetting agents, which disrupt the function of the coating, is advantageously made possible.

Furthermore, the inventors propose a device for the electrochemical coating of a substrate by brush plating, comprising a carrier through which liquid can pass for applying an electrolyte to a substrate to be coated, and a first conduit system for the electrolyte, which has outlets on the carrier.

A device of this type is described in JP 01301897 A, which has already been mentioned in the introduction. According to this document, the device for brush plating has a roller-shaped design, a sponge-like roller being used as the carrier. The interior of this roller is provided with the conduit system, which has the form of an elongate cylinder running in the center of the carrier. This tubular conduit system has a plurality of bores, which issue into the material of the carrier.

One possible object was to specify a device for the electrochemical coating of a substrate by brush plating, by which device it is possible to produce electrochemical layers, in which particles are dispersed, relatively effectively.

The inventors proposed the device having the second conduit system, which can be fed independently of the first conduit system and issues into the first conduit system or into the carrier. The device thereby provides a possible way of supplying the particles to be incorporated in the coating to be formed separately to the device. Depending on whether this second conduit system issues into the first conduit system, or issues directly into the carrier, it is possible to feed the particles to be incorporated in the coating into the coating electrolyte only just before the coating operation is carried out. This advantageously makes it possible to avoid the formation of a dispersion of the coating electrolyte and the particles to be incorporated. This makes it possible to incorporate particularly particles whose dispersion in the electrolyte is problematic as the dispersing agent in the electrochemically forming layer. By way of example, the use of wetting agents, which can have a negative influence on the layer result, can also be avoided, as already mentioned.

According to one refinement, the first conduit system and the second conduit system are combined in a conduit module, which is in contact with the carrier by way of its outlets. It is thereby possible to advantageously produce a particularly compact device, in which the paths which the electrolyte and the particles have to cover can be kept short. Agglomeration of the particles in the electrolyte can thereby advantageously be avoided as far as possible. In addition, the device advantageously has a simple design, so that it is possible, for example, to easily change the carrier.

According to another refinement, the second conduit system engages with a generator for ultrasound. The generator engages with the second conduit system by virtue of the fact that the ultrasound produced by the generator acts at least in the second conduit system. The ultrasound has the advantageous effect that particles conveyed in the second conduit system do not agglomerate. By way of example, a powder of particles conveyed in the second conduit system can also be kept in fluid form by the ultrasound. More precise details relating to how the ultrasound generator can be applied in the conduit system can be gathered, for example, from DE 10 2004 030 523 A1.

Additionally, it is advantageous if the points at which the second conduit system issues into the first conduit system or into the carrier are provided with metering valves, in particular piezo valves. This refinement, too, can be implemented by taking the details from DE 10 2004 030 523 A1, mentioned above, into consideration. Very precise metering of the particles to the electrolyte is advantageously possible owing to the use of the piezo valves, even if the particles are handled in the form of a powder.

It is particularly advantageous if the ultrasonic excitation acts not only on the second conduit system, but also on the first conduit system and/or on the carrier. It is thereby possible to avoid agglomeration of particles which may still be present in the electrolyte or agglomeration of the particles after they have been introduced into the electrolyte. In addition, mixing of the electrolyte with the particles is promoted by the influence of the ultrasound in the carrier.

BRIEF DESCRIPTION OF THE DRAWINGS

These and other objects and advantages of the present invention will become more apparent and more readily appreciated from the following description of the preferred embodiments, taken in conjunction with the accompanying drawings of which.

DETAILED DESCRIPTION OF THE PREFERRED EMBODIMENT

Figure 1:
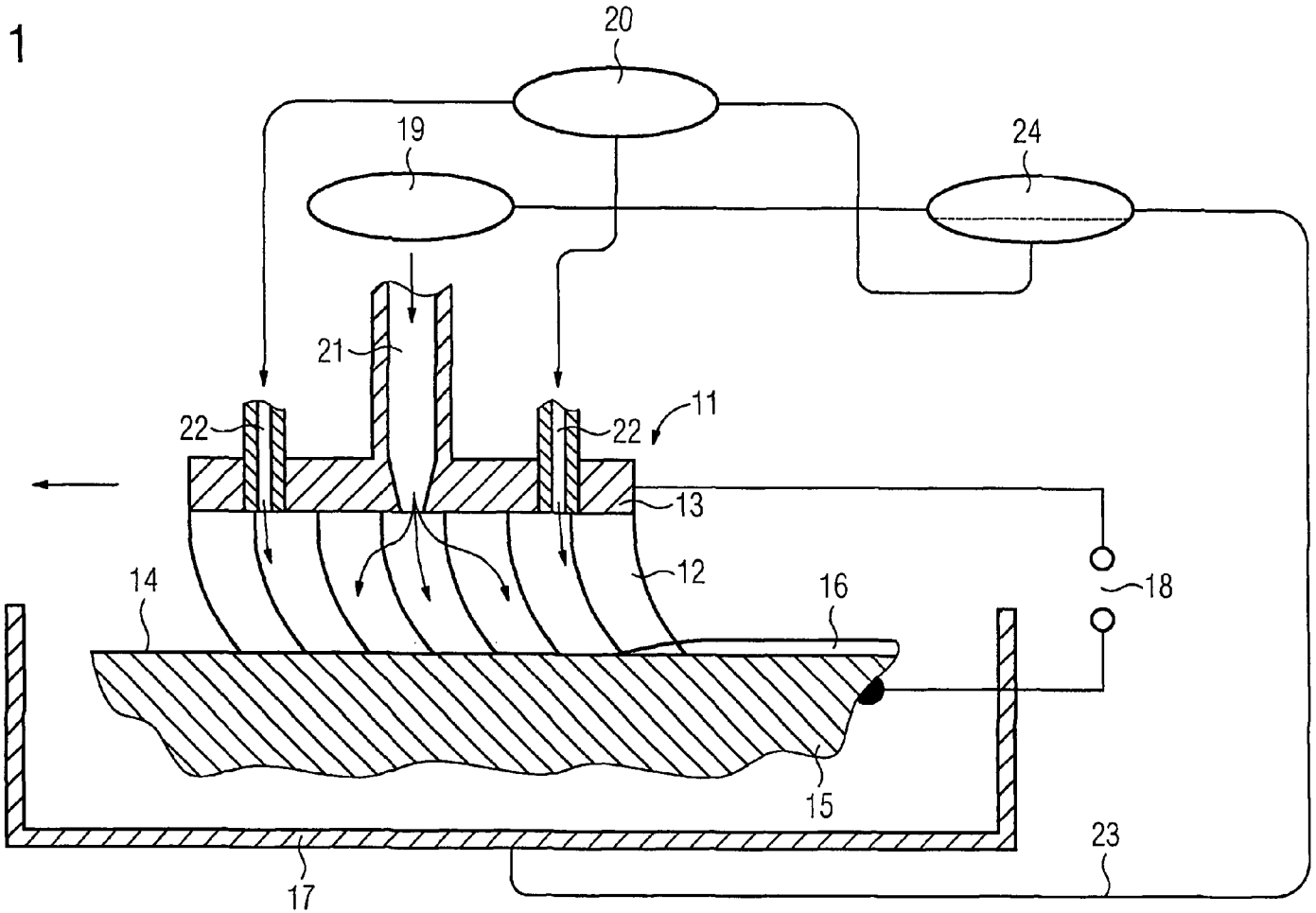
FIG. 1 schematically shows the course of an exemplary embodiment of the proposed process using an exemplary embodiment of the proposed device, FIG. 2 schematically shows another exemplary embodiment of the device in the form of an isometric view.

Reference will now be made in detail to the preferred embodiments of the present invention, examples of which are illustrated in the accompanying drawings, wherein like reference numerals refer to like elements throughout.

The proposed device 11 has a carrier 12 and a conduit module 13, to which the carrier 12 is connected. The carrier is a brush, which can be positioned on the surface 14 of a substrate 15. As will be explained in more detail below, the device can be used to produce a layer 16, in which particles (not shown in more detail) are dispersed, on the substrate 15.

In order to produce the layer 16, the substrate 15 is placed in a collection container 17. Furthermore, the substrate 15 and the device 11 are connected to a voltage source, the substrate being connected as cathode. An electrolyte is fed from an electrolyte supply container 19 into the carrier 12. This electrolyte contains ions of the coating material, which will form the metallic matrix (not shown in more detail) of the layer 16. In addition, there is a conduit from a particle supply container 20, which contains a highly-concentrated suspension of the particles to be incorporated in the layer 16, into the carrier 12.

The conduit module 13 has a first conduit system 21 for the electrolyte and a second conduit system 22 for the particles. These are independent of one another, i.e. the first conduit system can be fed by the electrolyte supply container 19 and, independently thereof, the second conduit system 22 can be fed by the particle supply container 20. The electrolyte is then mixed with the particles in the carrier, where a liquid having the composition of the electrolyte is preferably also used as the dispersing agent for the particles.

In order to form a layer 16, the device 11 is then drawn over the surface 14 in the direction indicated (arrow). During this process, a continuous flow of particles and electrolyte is maintained. The layer 16 is formed relatively quickly owing to the applied voltage, excess electrolyte mixed with the particles being collected in the collection container 17. A return conduit 23 leads from the latter to a separation device 24, where the particles are separated again from the electrolyte. The electrolyte, which then only contains insignificant quantities of particles, is returned back into the electrolyte supply container 19, and the particles, which are highly concentrated in the liquid of the electrolyte, are returned into the particle supply container 20. The coating process can then be continued with the recovered electrolyte and the recovered particles. In this case, it has to be taken into consideration that the material conversion taking place on the surface 14 during the formation of the layer 16 has to be compensated for (not shown).

Figure 2:
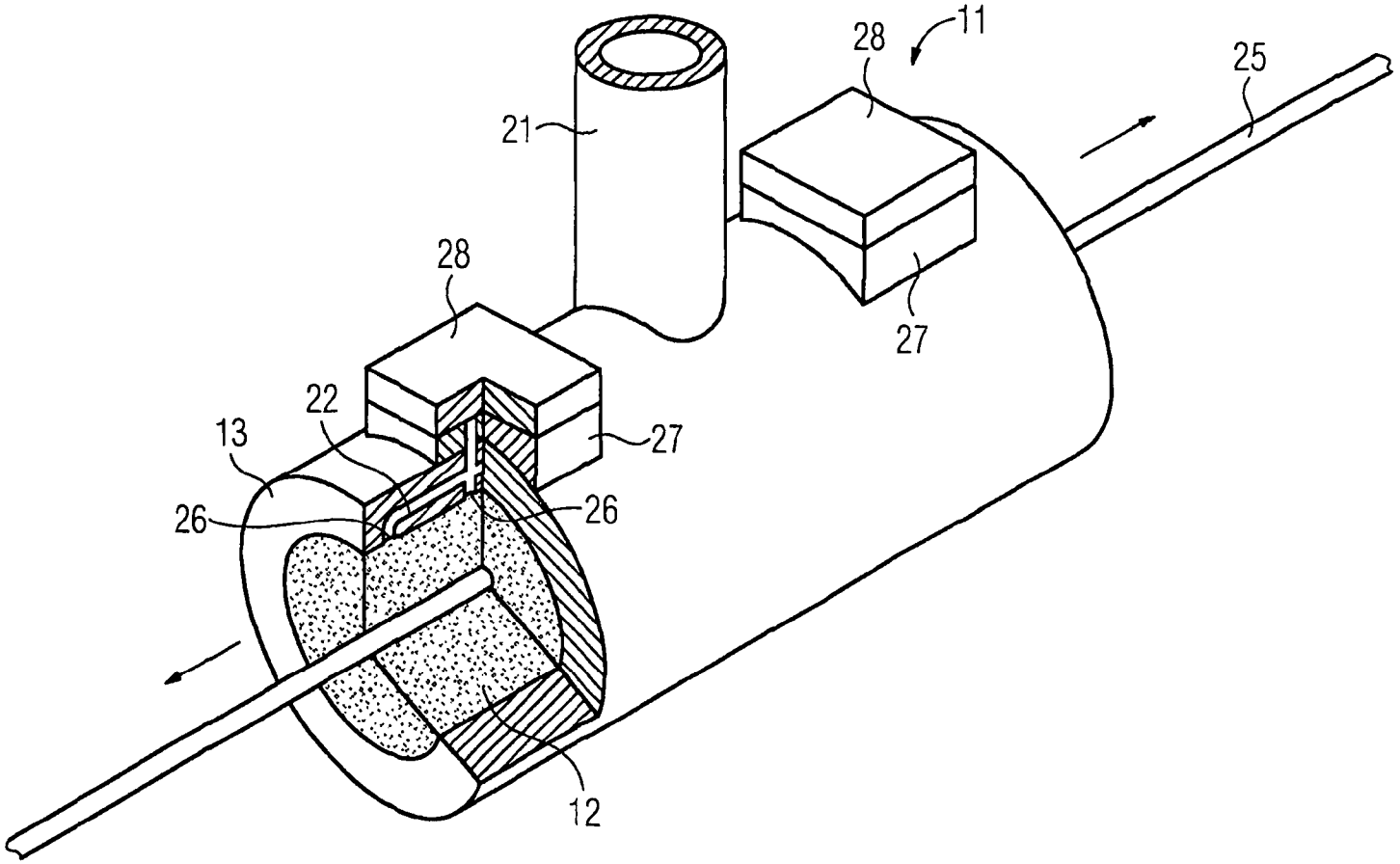

The device 11 according to FIG. 2 is suitable for coating a wire 25, which in this respect functions as the substrate 15 according to FIG. 1. The device therefore likewise has a tubular design. Initially, the carrier 12, which is an open-pored, sponge-like structure, has a cylindrical shape and has a through-opening for the wire 25 in the center axis. The device can be guided back and forth on the wire in the direction of the indicated arrows.

In order to make it possible to obtain a coating, the conduit module 13 is arranged annularly around the carrier 12, i.e. the conduit module forms a tubular sleeve. This is supplied with electrolyte via the first conduit system 21. In this case, use is made of a central stub, where the electrolyte is guided through the carrier 12, in the process also makes contact with the wire 25 and emerges at the ends of the tubular sleeve of the conduit module 13.

Furthermore, the second conduit system 22 is formed in the wall of the conduit module 13 and has a plurality of issuing points 26 for feeding the particles into the carrier 12. These issuing points are distributed uniformly over the length of the conduit module and also over the circumference thereof. Here, it is taken into account that the diffusion of the particles in the carrier 12 is limited compared to the electrolyte, and therefore uniform distribution in the carrier 12 is promoted by a relatively large number of issuing points 26.

The particles are introduced into the second conduit system 22 via connection modules 27 (not shown in more detail). In addition, these each have a generator 28 for ultrasound. These generators 28 are dimensioned such that the ultrasound waves propagate throughout the conduit module 13. The ultrasound counteracts agglomeration of the particles in the second conduit system 22.

Figure 3:
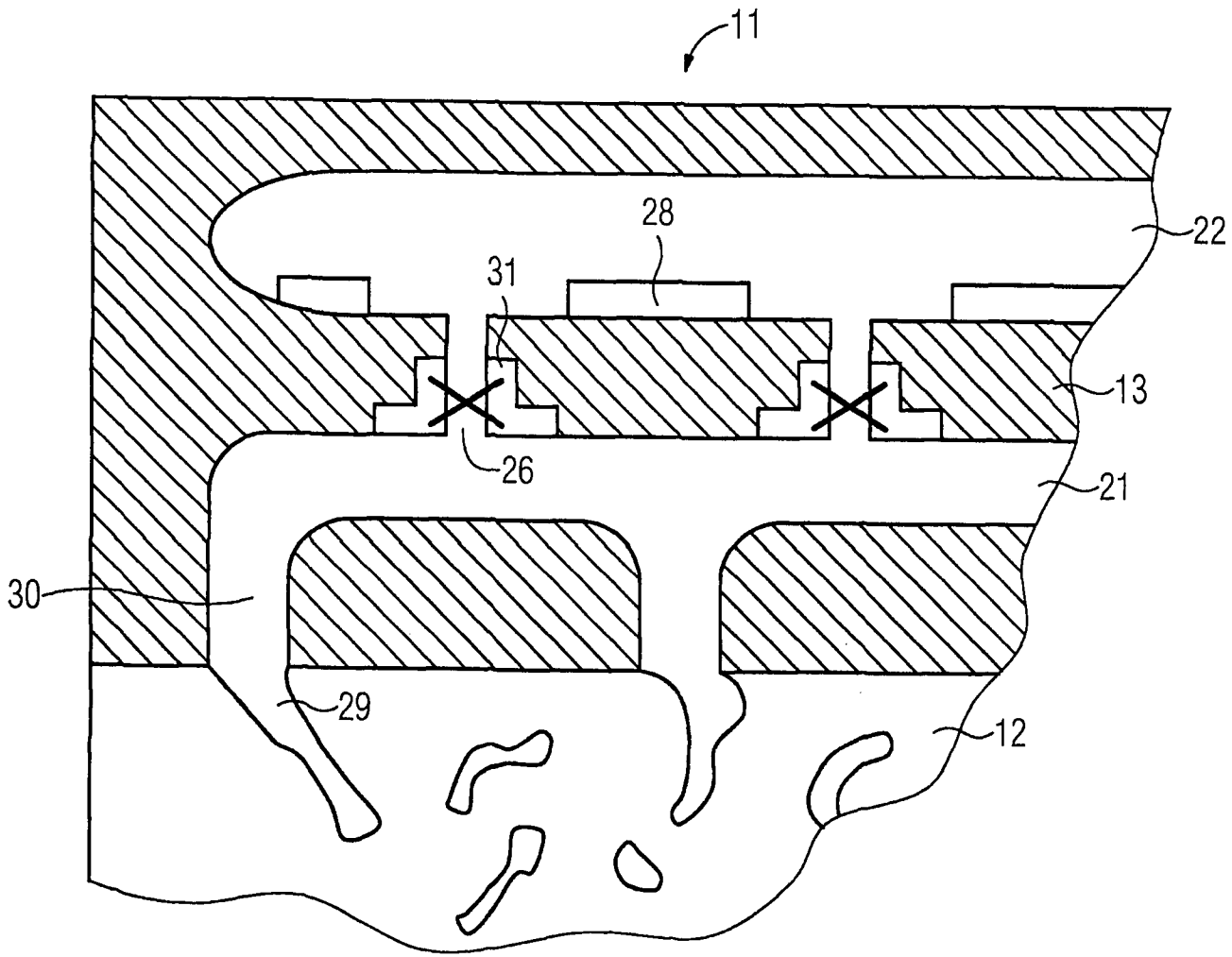
FIG. 3 is a cross-sectional view of a conduit module, as can be used in another exemplary embodiment of the device.

FIG. 3 shows a detail of the device, from which the interaction of the conduit module 13 and the carrier 12 can be gathered. The carrier 12 again has a sponge-like, elastic, open-pored structure, the pores 29 being visible. The conduit module has the first conduit system 21, which forms outlets 30 adjoining the carrier 12. The electrolyte can be pressed from the outlets into the pores 29.

In contrast to the exemplary embodiment according to FIG. 2, the second conduit system 22 is arranged parallel to the first conduit system 21. The issuing points 26 of the second conduit system do not lead into the carrier 12, but instead into the first conduit system 21. In this case, the electrolyte is therefore already mixed with the particles in the first conduit system, and this has the advantage that here the diffusion operations required for mixing can still proceed relatively undisturbed. The path which the electrolyte dispersion thus produced still has to cover in the carrier is short, and therefore neither separation nor agglomeration of the particles can occur.

The particles can preferably be conveyed in the second conduit system as a powder. In order to prevent agglomeration, the generators 28 are arranged directly in the second conduit system 22. By way of example, these can be formed by piezo crystals. Furthermore, metering of the powder located in the second conduit system 22 can be simplified by the provision of metering valves 31 at the issuing points 26. These can be designed as piezo valves. A very compact design of the conduit module can advantageously be implemented by using piezo technology. The paths in the first and second conduit systems can therefore be kept short, in order to preclude agglomeration of particles as far as the surface to be coated.

The invention has been described in detail with particular reference to preferred embodiments thereof and examples, but it will be understood that variations and modifications can be effected within the spirit and scope of the invention covered by the claims which may include the phrase "at least one of A, B and C" as an alternative expression that means one or more of A, B and C may be used, contrary to the holding in *Superguide v. DIRECTV,* 69 USPQ2d 1865 (Fed. Cir. 2004).

The invention claimed is:

1. A process for electrochemically coating a substrate by brush plating, comprising:

supplying an electrolyte, in which particles are dispersed, to a carrier, the electrolyte and the particles being supplied to the carrier by a process comprising:

supplying the electrolyte to the carrier via a first conduit system, in which the concentration of particles is at least reduced compared to a required concentration of particles for the coating, or no particles are present; and supplying particles to the carrier via a second conduit system fluidically independent from the first conduit system, the second conduit system adding particles to the electrolyte until the required concentration of particles is achieved therein;

using capillary channels in the carrier to guide the electrolyte, in which particles are dispersed, from the first and second conduit systems, to thereby form a dispersion on the substrate; and electrochemically forming a metallic layer from the electrolyte, in which particles are dispersed, the metallic layer having a matrix in which the particles are incorporated;

wherein the carrier is a brush.

2. The process as claimed in claim 1, wherein the required concentration of particles in the electrolyte is at a value above a critical value for stability of a particle-electrolyte dispersion.

3. The process as claimed in claim 1, wherein the particles are supplied in the second conduit system as a dispersion.

4. The process as claimed in claim 1, wherein the particles are conveyed in the second conduit system as a powder.

5. The process as claimed in claim 1, wherein ultrasound energy is applied to the second conduit system to prevent agglomeration of the particles.

6. The process as claimed in claim 1, wherein the particles are nanoparticles.

7. The process as claimed in claim 1, wherein the particles are carbon nano-tube (CNT) nanoparticles.

8. The process as claimed in claim 2, wherein the particles are supplied in the second conduit system as a dispersion.

9. The process as claimed in claim 8, wherein ultrasound energy is applied to the second conduit system to prevent agglomeration of the particles.

10. The process as claimed in claim 9, wherein the particles are carbon nano-tube (CNT) nanoparticles.

* * * * *